US005293724A

United States Patent [19]

Cornwall

[11] Patent Number: 5,293,724

[45] Date of Patent: Mar. 15, 1994

[54] COUPLING ASSEMBLY FOR CORRUGATED DECKS AND METHOD FOR CONNECTING THERETO

[76] Inventor: Kenneth R. Cornwall, 4963 Springfield Dr., Dunwoody, Ga. 30338

[21] Appl. No.: 885,298

[22] Filed: May 18, 1992

[51] Int. Cl.[5] ..... E04B 5/48

[52] U.S. Cl. ..... 52/220.8; 285/158; 52/741.1

[58] Field of Search ..... 52/221, 699, 701, 220, 52/741.1, 220.8; 285/189, 56, 58, 42, 201, 158

[56] References Cited

U.S. PATENT DOCUMENTS

| | | | |
|---|---|---|---|
| 3,426,492 | 2/1969 | Fork | 52/221 |
| 4,063,759 | 12/1977 | Steimle | 285/189 |
| 4,261,598 | 4/1981 | Cornwall . | |
| 4,377,925 | 3/1983 | Hoover | 52/220 X |
| 4,488,388 | 12/1984 | Schmit | 52/221 |
| 4,574,402 | 3/1986 | Brown, Sr. | 285/56 X |
| 4,583,565 | 4/1986 | Cornwall . | |
| 4,619,471 | 10/1986 | Harbeke | 52/221 X |
| 4,623,170 | 11/1986 | Cornwall . | |
| 4,638,829 | 1/1987 | Cornwall . | |
| 4,704,840 | 11/1987 | Gatto | 52/221 X |
| 4,724,858 | 2/1988 | Cornwall . | |
| 4,953,235 | 9/1990 | Cornwall . | |
| 5,076,309 | 12/1991 | Cornwall . | |

*Primary Examiner*—Carl D. Friedman

*Assistant Examiner*—Kien Nguyen

*Attorney, Agent, or Firm*—Ian C. McLeod

[57] ABSTRACT

An improved coupling assembly (10) mounted on a corrugated deck (30) and embedded in a concrete partition, such as floor (100), to provide an opening through the deck and the floor, is described. The coupling is comprised of an inner conduit (13) mounted inside of an outer sleeve (11). A flange portion (15) is provided at one end of the sleeve and includes openings (19) for fastening means, such as nails or screws (21) that serve to secure the coupling assembly in position on the deck. The conduit is mounted to the inside (11A) of the sleeve to position the opposed open ends (13B) and (13C) of the conduit extending beyond the sleeve means and through an opening (50) in the deck. The sleeve enables the contact point between the sleeve and the conduit to be adjusted along the length of the conduit. This is useful in those situations where the conduit has been mounted in an existing building construction or where the mounting position between the conduit and sleeve needs to be adjusted. The coupling is then embedded in the poured concrete floor and fluid carrying pipes can be connected to the opposed open ends of the conduit. The partition need not necessarily be a floor, but instead can comprise a wall. The floor can also be sloped and an upper end of the conduit can be provided with a drain conduit (61) for removing liquid from the top of the sloped floor.

33 Claims, 4 Drawing Sheets

Figure 1:
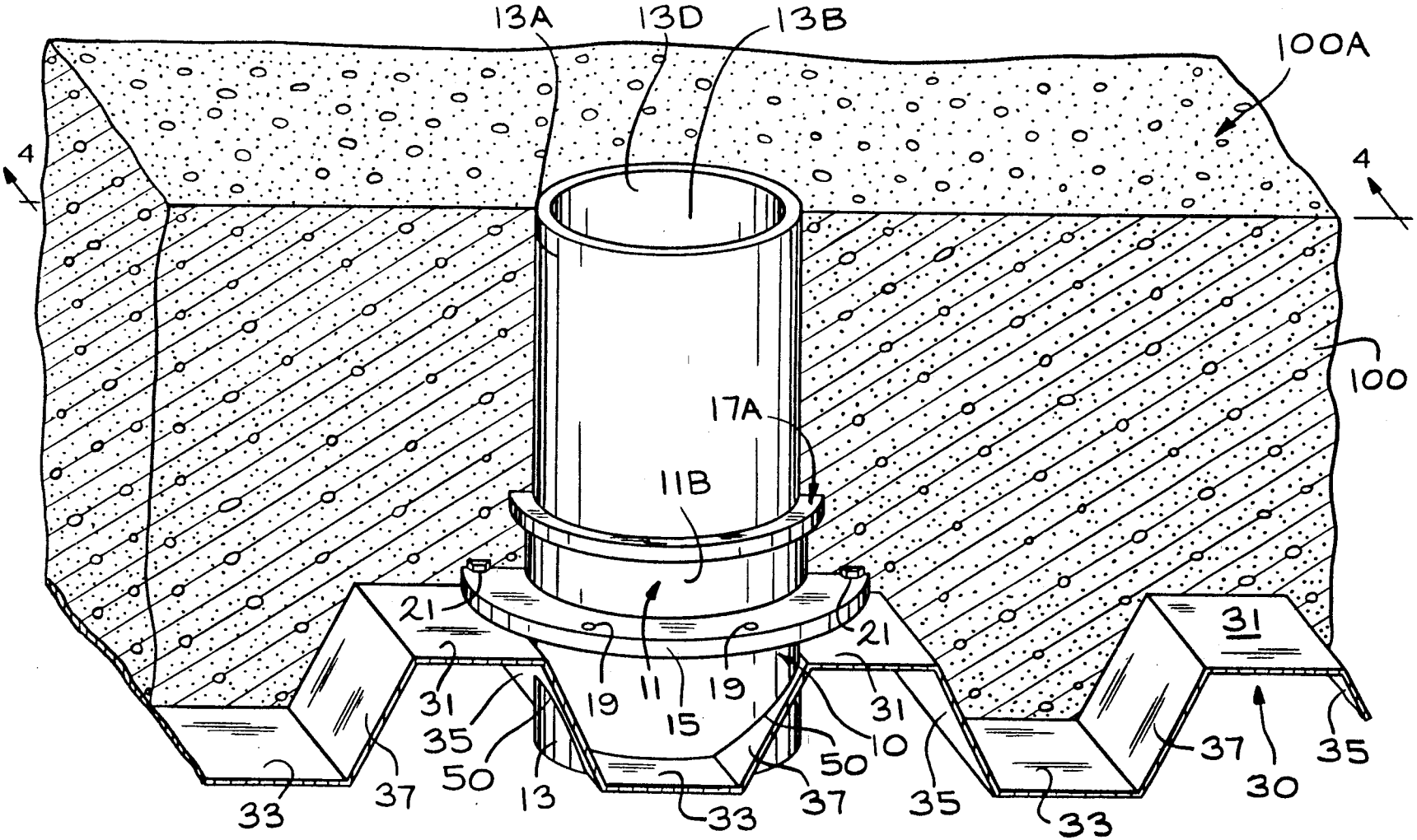

FIG. 2
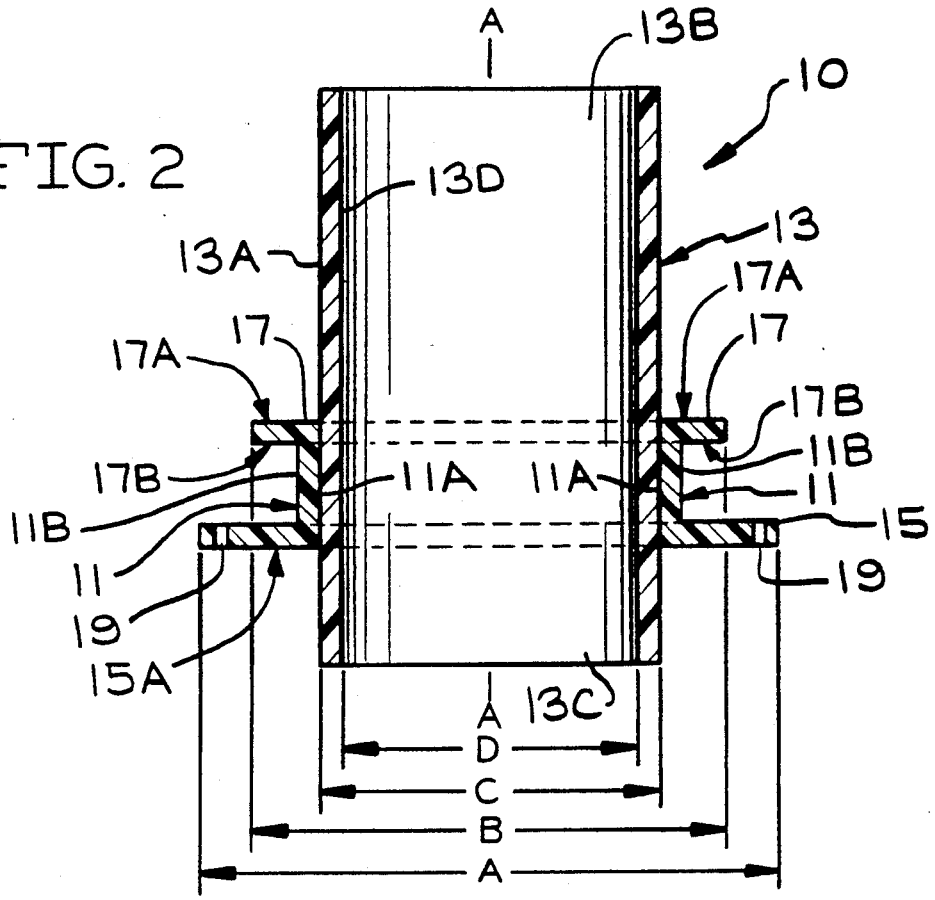
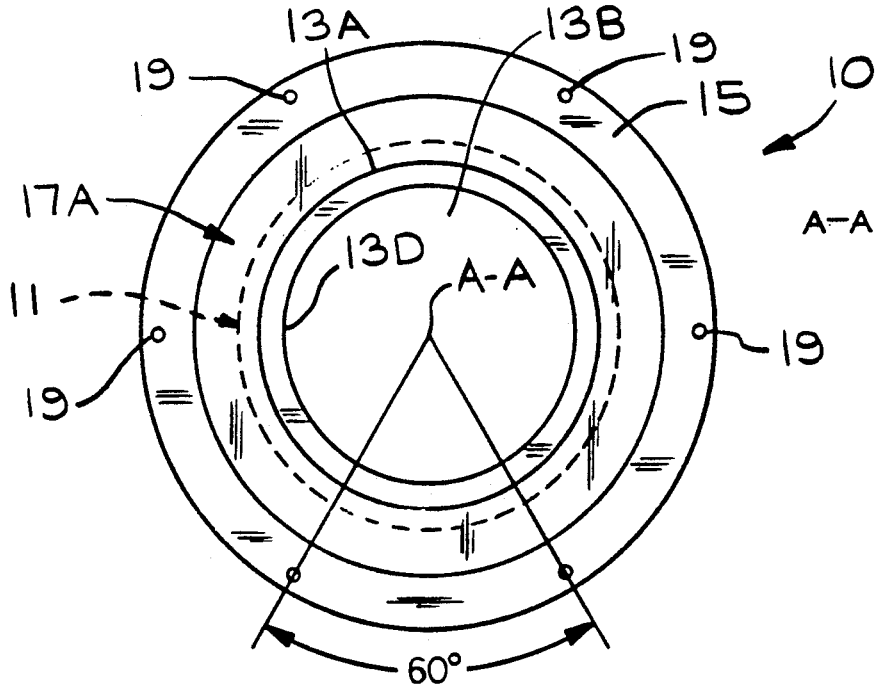
FIG. 3

COUPLING ASSEMBLY FOR CORRUGATED DECKS AND METHOD FOR CONNECTING THERETO

BACKGROUND THE INVENTION (1) Field of the Invention

The present invention relates to an improved coupling assembly for use in adjustably mounting a conduit through a corrugated deck. In particular, the present invention relates to a coupling assembly that enables fluid carrying pipes to be adjustably mounted through a corrugated deck. The coupling is comprised of a sleeve having a mounting flange secured to the deck. A fluid carrying conduit is then mounted inside the sleeve. The sleeve enables the contact position between the outside sidewall of the conduit and the inside sidewall of the sleeve to be adjustable along the length of the conduit.

To mount the coupling on the deck, a hole is first drilled through the corrugated deck and the flange portion of the sleeve is secured to at least two spaced apart ridge portions of the corrugated deck by screws, bolts or other suitable means so that the sleeve is concentric with the deck hole. In this position, the plane of the flange portion of the sleeve is parallel with the apices of the ridge portions of the corrugated deck. The conduit is then mounted inside the sleeve so that the conduit extends through the deck hole and beyond the opposed ends of the sleeve. Concrete forming a partition means can then be poured on the deck to form the floor and to embed the coupling in the floor. Fluid carrying pipes can also be connected to the opposed ends of the conduit to provide for moving fluids between the floor. The corrugated deck can also serve as a form for a wall as the partition means, or the floor can be sloped. In this case, the upper end of the conduit can be provided with a drain head for removing fluids from the floor.

(2) Prior Art

Couplings embedded in partitions, such as concrete walls and floors are well known. The couplings generally have a cylindrical sleeve that is mounted to a form for the wall or floor. After the partition is poured, the form can be removed or it can remain in place. The sleeve then provides an opening through the partition and serves for mounting fluid carrying pipes through the wall or floor.

My U.S. Pat. No. 4,261,598 describes a coupling for plastic fluid carrying pipes that is embedded in a concrete floor. The coupling is comprised of a tubular sleeve portion that is provided with a flange at one end for connecting the coupling to a form for the floor. When the floor is poured, the sleeve is embedded in the concrete to provide an opening through the floor. The sleeve is provided with an inner annular rim that has spaced apart parallel shoulders, perpendicular to the longitudinal axis of the sleeve. The shoulders serve to support fluid carrying pipes extending from the coupling on either side of the partition. This coupling is particularly adapted to be connected to a planar surface as the form for the concrete floor and the inner rim prevents the fluid pipes mounted inside the sleeve from being adjustable along the length of the pipes.

In my U.S. Pat. No. 4,623,170, an improved coupling for plastic, fluid carrying pipes that is embedded in a concrete partition is described. The coupling is provided with a flange at one end for connecting the coupling to a form for the concrete partition. The coupling also has multiple concentric rings on an outside wall of a sleeve portion. This helps prevent leakage between the outside wall of the coupling and the concrete partition. The sleeve is provided with an inner annular rim that serves to mount fluid carrying pipes on either side of the partition. This coupling is particularly adapted to be connected to a planar surface as the form for the concrete partition. Also, the inner rim prevents the fluid pipes mounted inside the sleeve from being adjustable along the length of the pipes.

My U.S. Pat. Nos. 4,583,565; 4,638,829; 4,724,858; 4,953,235, describe firestop fittings particularly adapted to prevent the spread of smoke and fire between floors in a multi-story building by plugging off any potential fire path through a vertical pipe mounted between the floors. These patents describe an assembly where a non-flammable plug is released by heat less than required for heat destruction of a plastic coupling mounted in a concrete floor. Upon being released, the plug moves into and seals in an iron fitting mounted inside of the plastic coupling to serve as a non-flammable barrier through the iron fitting. This retards the spread of fire through the plastic coupling by depriving the inside of the coupling of oxygen.

My U.S. application Ser. No. 07/692,669 filed Apr. 29, 1991, describes a similar firestop fitting having a moveable plug for plugging off a vertical pipe mounted between fire rated floor members. My U.S. application Ser. No. 07/701,057 filed May 16, 1991, describes a firestop fitting having a moveable plug for plugging off a horizontal pipe mounted between vertical, fire rated wall members. These inventions are particularly adapted to prevent the spread of smoke and fire through the pipe by plugging off the inside of the pipe.

My U.S. Pat. No. 4,953,235 describes a trap fitting assembly that uses a flammable coupling vertically mounted through a concrete floor. A non-flammable sleeve is mounted inside the coupling and extends below the coupling for connection to a non-flammable J-pipe. The J-pipe contains water at a level sufficient to prevent smoke and fire from spreading through the floor through the flammable coupling. The sleeve prevents fire from spreading through the trap fitting by depriving the inside of the coupling of the necessary oxygen needed to sustain the spread of fire through the coupling. This invention is preferably adapted for a floor drain outlet or a tub.

My U.S. application Ser. No. 07/700,406 filed May 15, 1991, describes a trap fitting assembly for mounting in a flammable floor to prevent the spread of smoke and fire through the floor and a lower ceiling. The fitting assembly is comprised of a flammable connection mounted inside of a non-flammable threaded nipple that is mounted in an opening in a support means supported in the floor. A non-flammable J-pipe threads onto a lower extension of the nipple and contains water at a level sufficient to prevent smoke and fire from spreading through the fitting assembly. This invention is preferably adapted for mounting in a tub box as the support means and the connection is preferably a T-connection for draining a tub through an overflow pipe and a drain pipe connected to a tub drain.

My U.S. Pat. No. 5,076,309 describes a firestop stub-out assembly, which includes a non-flammable insert having an annular flange at one end. The insert is mounted inside of a flammable, plastic sleeve and locked in place by a plastic coupling that mounts over and around the flange portion of the insert. This invention is adapted to be mounted through a fire rated wall member, to provide a means for coupling a water operated fixture mounted in a room and to fluid carrying conduits mounted between spaced apart fire rated wall members.

What is needed is a coupling assembly that provides for adjustably mounting a fluid conduit inside the sleeve portion of the assembly so that the contact position between the conduit and the sleeve is adjustable along the length of the conduit. This is useful in those situations where the conduit has already been mounted in an existing building construction or where the conduit is needed to be adjustable with respect to the sleeve.

It is a further point of the present invention to provide a means for quickly and easily mounting the sleeve to a support such as a corrugated deck for mounting fluid carrying pipes through the deck. Until the present invention, the most accepted method has been to first cut an opening in the corrugated deck and then weld an oversized steel pipe to the deck, around the opening. A conduit section mounted inside the steel pipe and through the opening in the deck is then welded to the steel pipe. Fluid carrying pipes can be connected to the opposite ends of the conduit section for moving fluids through the corrugated deck.

This prior art method requires that the deck be made of a metal material, and that the oversized pipe be made of a weldable, metal material. The coupling assembly of the present invention is able to be mounted to corrugated decks that are made of both metal materials and non-metal materials. The flange portion of the sleeve provides for bolting, screwing, gluing or similarly securing the coupling to the corrugated deck so that a conduit portion of the coupling extends through an opening in the deck. Fluid carrying pipes can then be connected to the coupling assembly on either side of the deck, or the deck can first serve as a support for pouring a concrete partition before the fluid carrying pipes are connected to the coupling assembly.

OBJECTS

It is therefore an object of the present invention to provide a coupling assembly that provides for adjustably mounting a conduit through a sleeve portion of the coupling. Further, it is an object of the present invention to provide for mounting fluid carrying pipes through a corrugated deck for moving fluids through the pipes and through the deck. Still further, it is an object of the present invention to provide a coupling assembly that is securable to the apices of two or more spaced apart ridge portions of a corrugated deck and wherein the coupling assembly provides a means for adjustably connecting fluid carrying pipes through an opening in the corrugated deck. Furthermore, it is an object of the present invention to provide a method for mounting a coupling assembly to a support such as a corrugated deck for connecting fluid carrying pipes through an opening in the deck. Finally, it is an object of the present invention to provide a coupling assembly that is inexpensive to manufacture and easily mounted to a support such as a corrugated deck, which can serve as a support for a poured concrete partition, and wherein the coupling assembly provides for connecting fluid carrying pipes through an opening in the deck and the partition. These and other objects will become increasingly apparent by reference to the following descriptions and to the drawings.

IN THE DRAWINGS

FIG. 1 is a partially cut away perspective view of the preferred embodiment of an improved coupling assembly 10 of the present invention mounted on a corrugated deck 30 and embedded in a concrete floor 100.

FIG. 2 is a cross-sectional view of the improved coupling assembly 10 shown in FIG. and showing the coupling assembly 10 comprised of a conduit 13 mounted inside a sleeve 11 having a flange 15 that provides for mounting the coupling assembly 10 on the corrugated deck 30.

FIG. 3 is a plan view of the conduit 13 mounted inside of the sleeve 11 to form the coupling assembly 10.

Figure 4:
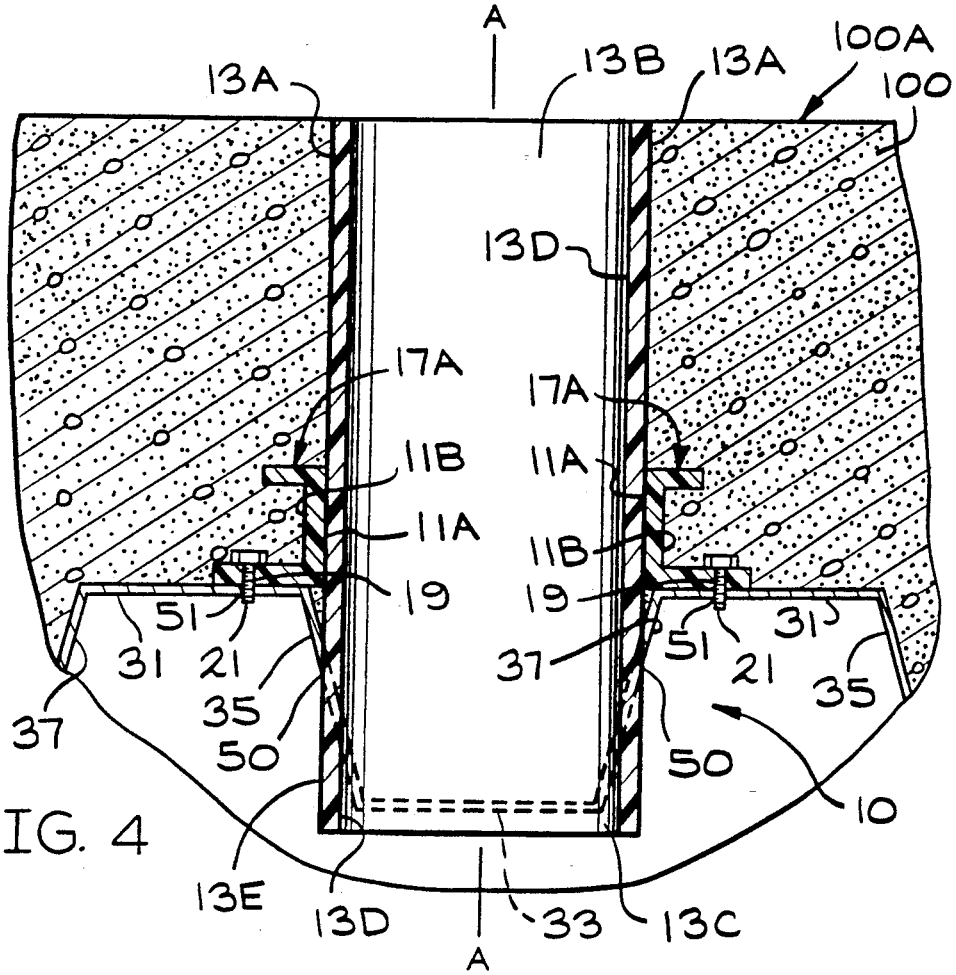

FIG. 4 is a cross-sectional view along line 4—4 of FIG. 1 showing conduit 13 mounted inside the sleeve 11 with the flange 15 mounted on the corrugated deck 30, which supports the concrete floor 100, to embed the coupling assembly 10 in the floor 100.

Figure 5:
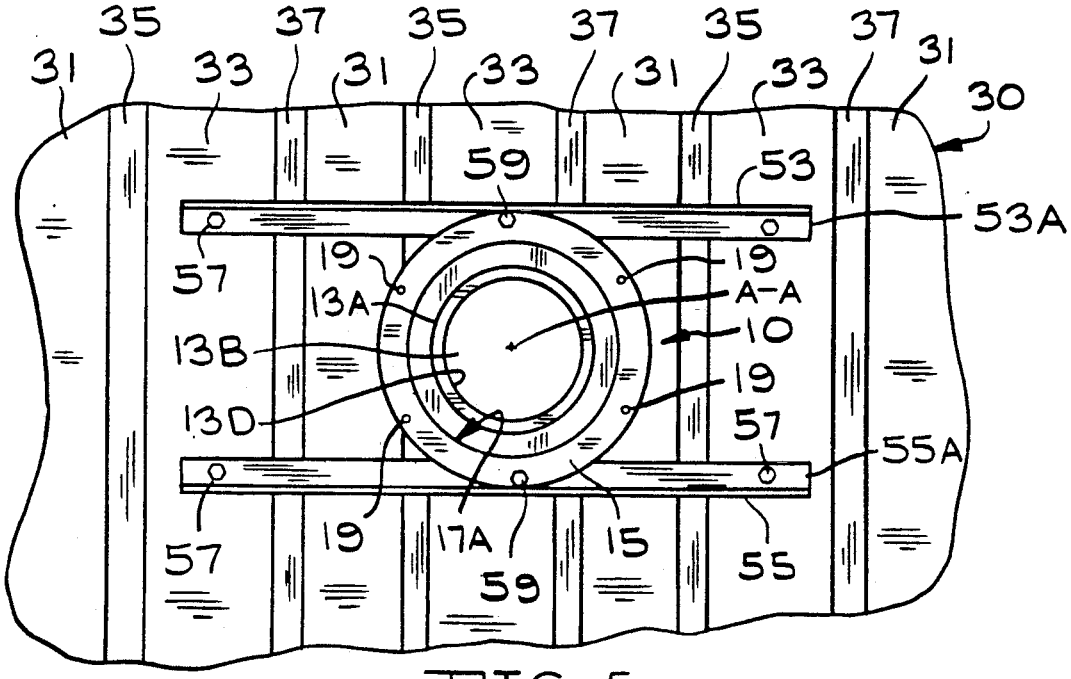

FIG. 5 is a plan view of the flange 15 mounted to a pair of spaced apart braces 53 and 55 for mounting the coupling assembly 10 to the corrugated deck 30.

Figure 6:
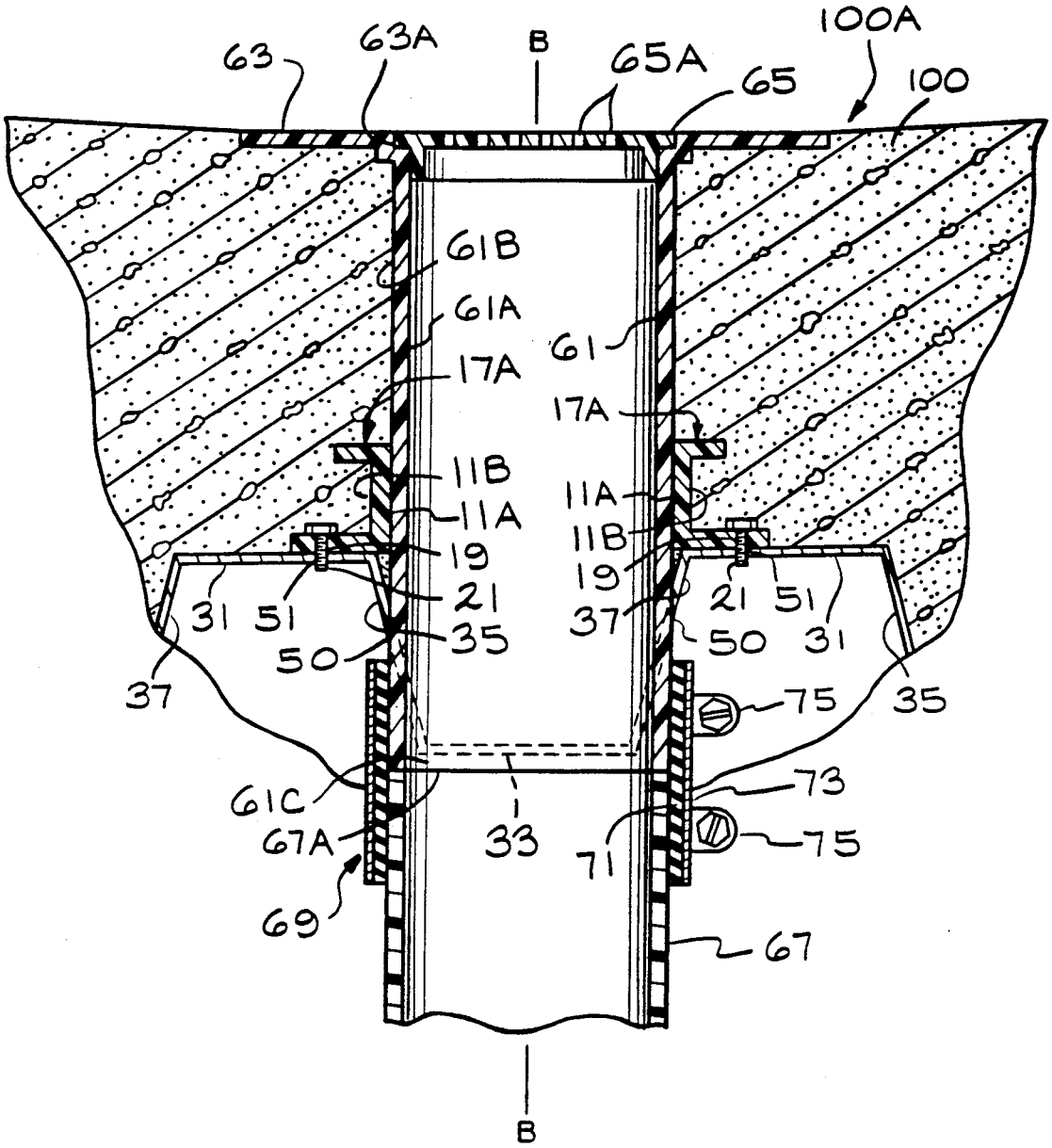

FIG. 6 is a cross-sectioned view showing a drain conduit 61 with drain grate 65 mounted inside the sleeve 11 of the coupling assembly 10 shown in FIG. 1 with a fluid conduit 67 mounted to the drain conduit 61 by band clamp 69.

GENERAL DESCRIPTION

The present invention relates to a fitting assembly adapted to be secured to a deck means comprised of alternating side-by-side ridge and valley portions providing a corrugated shape and wherein the fitting assembly serves for carrying a fluid through an opening in the deck means, which comprises: a sleeve means having an outside sidewall between opposed open ends and an inside sidewall providing an opening along a longitudinal axis of the sleeve means; an attachment means extending from the sleeve means away from the longitudinal axis, wherein the attachment means serves to secure the sleeve means to the deck means mounted on an apex portion of at least two spaced apart ridge portions or valley portions of the corrugated deck means; and a fluid carrying conduit means adapted to be mounted through the opening in the sleeve means and comprised of an outside sidewall secured to the inside sidewall of the sleeve means and an inside sidewall between opposed open ends defining a second opening through the conduit means for carrying the fluid and the conduit means having a length so that the outside sidewall of the conduit means is able to be adjustably mounted along the inside sidewall of the sleeve means to adjust a distance between one of the opposed open ends of the conduit means and one of the opposed open ends of the sleeve means and wherein the opposed open ends of the conduit means extend through the opening in the deck means to provide for carrying the fluid through the deck means.

Furthermore, the present invention relates to a method for connecting a fitting assembly through an opening in a deck means comprised of alternating side-by-side ridge and valley portions in a corrugated shape, wherein the fitting assembly serves to carry a fluid through the opening in the deck means, which comprises: providing the fitting assembly, which comprises: a sleeve means having an outside sidewall between opposed open ends and an inside sidewall providing an opening along a longitudinal axis of the sleeve means; an attachment means extending from the sleeve away from the longitudinal axis, wherein the attachment means serves to secure the sleeve means to the deck means mounted on an apex portion of at least two spaced apart ridge portions or valley portions of the corrugated deck means; and a fluid carrying conduit means adapted to be mounted through the opening in the sleeve means and comprised of an outside sidewall secured to the inside sidewall of the sleeve means and an inside sidewall between opposed open ends defining a second opening of the sleeve means for carrying the fluid and the conduit means having a length so that the outside sidewall of the conduit means is able to be adjustably mounted along the inside sidewall of the sleeve means to adjust a distance between one of the opposed open ends of the conduit means and one of the opposed open ends of the sleeve means and with the opposed open ends of the conduit means extending through the opening in the deck means; providing the deck means having the opening and securing the sleeve means to the apex portions of at least two spaced apart ridge portions or valley portions of the corrugated deck means by the attachment means so that the inside sidewall of the sleeve means is aligned with the opening through the deck means; mounting the conduit means inside the sleeve means with the outside sidewall of the conduit means secured to the inside sidewall of the sleeve means and with the opposed open ends of the conduit means extending through the opening in the deck means and beyond the opposed open ends of the sleeve means to provide for moving a fluid through the conduit means and through the opening in the deck means; and moving the fluid through the conduit means secured to the inside sidewall of the sleeve means so that the fluid moves through the opening in the deck means.

Finally, the present invention relates to a building construction comprising a building having a fitting assembly mounted through an opening in a deck means for carrying a fluid through the opening in the deck means, wherein the deck means is comprised of alternating side-by-side ridge and valley portions in a corrugated shape, which comprises: the fitting assembly, which comprises: a sleeve means having an outside sidewall between opposed open ends and an inside sidewall providing an opening along a longitudinal axis of the sleeve means; an attachment means extending from the sleeve means, away from the longitudinal axis, wherein the attachment means serves to secure the sleeve means to the deck means mounted on an apex portion of at least two spaced apart ridge portions or valley portions of the corrugated deck means; and a fluid carrying conduit means adapted to be mounted through the opening in the sleeve means and through the opening in the deck means, and comprised of an outside sidewall between opposed open ends and an inside sidewall defining a second opening for carrying the fluid and the conduit means having a length so that the outside sidewall of the conduit means is adjustable along the inside sidewall of the sleeve means to adjust a distance between one of the opposed open ends of the conduit means and one of the opposed open ends of the sleeve ends and wherein the opposed open ends of the conduit means extend through the opening in the deck means to provide for carrying the fluid through the opening in the deck means; and the deck means with the fitting assembly secured to the deck means so that the conduit means extends through the opening in the sleeve means and through the opening in the deck means for moving the fluid through the opening in the deck means.

SPECIFIC DESCRIPTION

FIG. 1 shows the preferred embodiment of an improved coupling assembly 10 mounted on a corrugated deck 30 and embedded in a concrete partition, such as floor 100, to provide an opening through the deck 30 and the floor 100. The corrugated deck 30 serves as a support for pouring the concrete floor 100.

As particularly shown in FIGS. 2 and 3, the coupling assembly 10 has a generally circular cross-section along and around a longitudinal axis A—A. The coupling assembly 10 is preferably made of an injection molded Type fire rated polyvinyl chloride plastic (PVC) having a flame spread rating of 20, which is well known to those skilled in the art. The coupling assembly 10 includes an outer sleeve 11 that provides for mounting an inner conduit 13 inside the sleeve 11. The sleeve 11 has cylindrical inside wall 11A defining the longitudinal axis A—A and a parallel, cylindrical outside wall 1IB. One end of the sleeve 11 has a flange 15 that provides for mounting the coupling assembly 10 on the corrugated deck 30 while the opposite end of sleeve 11 is provided with a concentric ring 17. Ring 17 has an upper surface 17A and a lower surface 17B that are both perpendicular to the longitudinal axis A—A of the sleeve 11. Flange 15 has openings 19 (FIG. 3) that provide for mounting fastening means, such as nails or screws 21 to secure the coupling assembly 10 on the deck 30. As shown in the plan view in FIG. 3, the openings 19 are preferably spaced at 60° intervals around the circumference of the flange 15. The lower surface 15A of the flange 15 can also be secured to the deck 30 by gluing (not shown) or other suitable securing means.

The conduit 13 has a tubular shape with a cylindrical outside sidewall 13A between opposed open ends 13B and 13C. A cylindrical inside wall 13D is parallel with the outside wall 13A around the longitudinal axis A—A. When the conduit 13 is mounted inside the sleeve the outside wall 13A of the conduit 13 is in contact with the inside wall 11A of the sleeve The conduit 13 is preferably press fit inside the sleeve 11 so that the contact point between the sleeve 11 and conduit 13 is adjustable along the length of the conduit 13. That way, the conduit 13 can be solvent welded or bonded to the sleeve 11 to provide a weather impervious barrier between the sleeve 11 and the conduit 13.

As shown in FIGS. 1, 4 and 5, the deck 30 has a corrugated shape in the form of alternating side-by-side ridges and valleys. The corrugated shape is comprised of a plurality of spaced apart horizontal lower sides 33 connected to the preceding upper sides 31 by a first oblique side 35 and connected to the following upper sides 31 by a second oblique side 37. The first and second oblique sides 35 and 37 are angled in opposite directions with respect to a vertical plane through the axis A—A. The deck 30 is preferably made from a sheet of metal material and is formed into the corrugated shape by bending the metal sheet. The corrugated deck 30 can also be made of plastic or fiberglass materials. Further, the upper and lower sides 31 and 33 need not be horizontal, but can also have a rounded or curved shape. In this case, the first and second oblique sides 35 and 37 would also be rounded or curved so that in an end view (FIG. 4), the deck 30 would have a sinusoidal shape (not shown).

IN USE

In use, the improved coupling assembly 10 of the present invention provides a means for mounting the conduit 13 as a fluid carrying pipe through the corrugated deck 30 and through the concrete floor 100, supported by the deck 30. Before the coupling assembly 10 is mounted to the corrugated deck 30, a hole or opening 50 is cut through the deck 30. The opening 50 will later serve to mount the conduit 13 inside the sleeve 11 and through the deck 30 after the flange 15 and sleeve 11 have been mounted on the corrugated deck 30, as shown in FIG. 1. Before that, the flange 15 is positioned on adjacent upper sides 31 of the corrugated deck 30 with the longitudinal axis A—A of the sleeve 11 concentric with the axis of the opening 50 through the deck 30. The sleeve 11 is then rotated so that at least one opening 19 through the flange 15 is aligned above each of two upper sides 31 of the corrugated deck 30. A hole 51 (FIG. 4) is then drilled through each of the upper sides 31 and the bolt or screw 21 is secured in place through the opening 19 in flange 15 and through the hole 51 to mount the flange 15 and sleeve 11 on the corrugated deck 30.

As shown in FIG. 5, if the corrugated shape of the deck 30 does not enable the flange 15 to be mounted on the deck 30 as explained above, a pair of angled braces 53 and 55 can be used. The angled braces 53 and 55 have horizontal portions 53A and 55A that are mounted on the upper portions 31 of the corrugated deck 30, perpendicular to the longitudinal axis of the side-by-side ridges and valleys formed by the deck 30. The horizontal portions 53A and 55A have openings (not shown) that provide for mounting the braces 53 and 55 to the corrugated deck 30 using bolts 57, or other suitable fastening means. The flange 15 of coupling assembly 10, is then mounted on the horizontal portions 53A and 55A of the angled braces 53 and 55 with one of the openings 19 through the flange 15 in line with each one of the horizontal portions 53A and 55A. This enables the flange 15 to be mounted to the angled braces 53 and 55 by bolts 59 of other suitable fastening means.

It should be understood that the braces 53 and 55 need not necessarily be aligned in parallel as shown in FIG. 5. Instead, the braces 53 and 55 can be angled with respect to each other. What is important is that each brace 53 and 55 span at least two upper portions 31 of the corrugated deck 30 and that at least one opening 19 through the flange 15 is in line over each brace 53 and 55. That way, the flange 15 of the sleeve 11 is mounted to the braces 53 and 55 which in turn are mounted to the deck 30. It is also contemplated by the scope of the present invention that only one of the angled braces 53 or 55 could be used to serve as a shim for one side of the coupling assembly 10. This would be useful for varying the angle between the plane of the apices of the upper sides 31 of the corrugated deck 30 and the plane of the flange portion 15 of the sleeve 11.

For added support, there can also be provided cross-braces (not shown) that extend between the opposed braces 53 and 55 and which can be connected to the flange 15, 90° offset from the point where the braces 53 and 55 connect the flange 15. The cross braces need not be bolted or otherwise connected to the flange 15 to add support to the sleeve 11. Instead, the cross-braces need only be secured to the braces 53 and 55 by bolts, screws, welding or some other suitable means. As long as a horizontal portion of the cross-braces is mounted underneath the flange 15 and the cross-braces are in turn mounted to the deck 30 or to the angled braces 53 and 55, the cross-braces will serve to help support the flange 15. The use of the braces 53 and 55 might be especially applicable with those corrugated decks 30 having a rounded, sinusoidal shape, In this case, it might be hard to position the flange 15 so that at least one opening 19, through the flange 15 is in line with two spaced apart upper portions 31 of the deck 30 for securing the flange 15 to the deck 30, as previously described.

After the flange 15 has been mounted to the corrugated deck 30, the conduit 13 is press fit inside the sleeve 11 with a lower portion 13E of the conduit 13 extending through the opening 50 in the deck 30. The lower portion 13E of conduit 13 can extend to a position that is coplanar with the lower side of the deck 30 or to a position spaced below the horizontal lower sides 33 (FIGS. 1 and 4), which is preferred. A portion of the outside wall 13A of the conduit 13 is now in contact with the inside wall 11A of the sleeve 11. This contact point is adjustable along the length of the conduit 13. The conduit 13 is then solvent welded or bonded to the sleeve 11 and the conduit 13. Preferably, the conduit 13 extends above the corrugated deck 30 a distance similar to the thickness of the floor 100 to be poured on the deck 30.

With the conduit 13 extending to a predetermined height above the corrugated deck 30, a cover or cap (not shown) is placed over the upper open end 13B of the conduit 13. The cover prevents concrete 100 from entering the inside of the conduit 13 as the concrete floor 100 is being poured. The cover also allows a concrete finisher to smooth an upper surface 100A of the concrete 100 around the coupling assembly 10. The cover, which is usually a bright color for easy detection, is then removed after the concrete 100 is set. With the coupling assembly 10 embedded in the concrete floor 100, the concentric ring 17 both helps to bond the sleeve 11 to the concrete 100 and to prevent the seepage of fluids between the concrete 100 and the coupling 10, past the sleeve 11.

Fluid carrying pipes (not shown in FIGS. and 4), can then be mounted to the opposed open ends 13B and 13C of the conduit 13. If there is a sufficient length of conduit 13 extending past the concrete floor 100 and/or the corrugated deck 30, the fluid carrying pipes can be band clamped to the conduit I3, as is well known to those skilled in the art. It is also contemplated by the scope of the present invention that the fluid carrying pipes can be mounted inside the conduit 13 in a press fit manner and solvent welded in place. In this case, there can be provided an inner annular rim (not shown) mounted on the inside wall 13D of the conduit 13 so that the fluid pipes can abut against either side of the rim for added stability.

The corrugated deck 30 and the concrete partition 100 need not necessarily comprise a horizontal floor. Instead, the deck 30 and partition 100 can be vertical to provide a wall or they can have an angled slope. Providing the concrete floor 100 with a slope would be useful for draining liquids from the floor 100. As shown in FIG. 6, the cylindrical conduit 13 would be replaced by a drain conduit 61 having a generally tubular shape around the axis B—B, formed by a cylindrical inside sidewall 61A and a parallel outside sidewall 61B extending upward to an upper drain flange 63. The drain flange 63 has an annular shape with an inner annular ridge 63A that provides for mounting a drain grate 65.

Drain grate 65 has openings 65A that enable water to flow into and through the drain conduit 61 leading to a fluid carrying pump 67 connected to a lower open end 61C of the drain conduit 61 by a band clamp 69. The band clamp 69 is comprised of a flexible rubber or plastic sleeve 71 reinforced with a steel band (not shown) and having an adjustable ring clamp 73 mounted in the middle of the sleeve 71. The ring clamp 73 is adjusted by a pair of adjusting screws 75.

To connect the fluid pipe 67 to the drain conduit 61, the band clamp 69 having the adjustable ring clamp 73 in a loose position is first slid over the lower open end 61C of the drain conduit 61, or over the open end 67A of the pipe 67. The drain conduit 61 and the fluid pipe 67 are then abutted against each other and the sleeve 71 of the band clamp 69 is centered at the abutment. The adjusting screws 75 are then turned to tighten the ring clamp 73 onto the sleeve 71 of the band clamp 67, forming a water tight seal between the drain conduit 61 and the pipe 67. This type of connection with the band clamp 69 is well known to those skilled in the art. Also, if the pipe 67 and sleeve 71 of the band clamp 69 are plastic, they can be joined by solvent welding for added sealing.

Table 1 is a chart showing the preferred dimensions for the coupling assembly 10 for connecting various sizes of fluid carrying pipe 67 through the corrugated deck 30 and the concrete partition 100. As shown in FIG. 2 and in reference to Table "A" represents the outside diameter of the flange 15, "B" represents the outside diameter of the concentric ring 17, "C" represents the inside diameter of the inside wall 11A of sleeve 11 and "D" represents the inside diameter of the inside wall 13D of the conduit 13

TABLE 1

| | DIMENSIONS (IN INCHES) | | | |
|---|---|---|---|---|
| Size of fluid pipes | A inches | B inches | C inches | D inches |
| 2 inches | 5.00 | 3.75 | 2.75 | 2.40 |
| 3 inches | 6.27 | 5.02 | 4.02 | 3.52 |
| 4 inches | 7.25 | 6.00 | 5.00 | 4.52 |
| 6 inches | 9.52 | 8.27 | 7.27 | 6.65 |

Adjustably mounting the conduit 13 inside the sleeve 11 to form the coupling assembly 10 also makes it possible for the coupling assembly 10 to be connected to fluid carrying pipes that have previously been mounted in an existing construction. Furthermore, it should be noted that the coupling assembly 10 can be used with the corrugated deck 30 alone. If the concrete floor 100 is not poured over the deck 30, the coupling assembly 10 still provides an acceptable means of connecting fluid carrying pipes through the opening 50 in the corrugated deck 30.

Finally, the coupling assembly 10 can also be mounted to the valleys of the corrugated deck 30. In this case, the flange 15 is secured to the lower sides 33 in a similar manner as the flange 15 is mounted on the upper sides 31 of the corrugated deck 30. This construction would likely be used if space prevented the coupling assembly 10 from being mounted on the upper sides 31 of the deck 30.

Numerous variations will occur to those skilled in the art. It is intended that the foregoing descriptions be only illustrative of the resent invention and that the present invention be limited only by the hereinafter appended claims.

I claim:

1. A fitting assembly adapted to be secured to a deck means comprises of alternting side-by-side ridge and valley portions providing a corrugated shape and wherein the fitting assembly serves for carrying a fluid through an opening in the deck means, which comprises:

(a) a sleeve means having an outside sidewall between opposed open ends and an inside sidewall providing an opening along a longitudinal axis of the sleeve means and with an annular ring around the outside sidewall of the sleeve means;

(b) an attachment means extending from the sleeve means away from the longitudinal axis, wherein the attachment means serves to secure the sleeve means to the deck means mounted on an apex portion of at least two spaced apart ridge portions or valley portions of the corrguated deck means; and (c) a fluid carrying conduit means adapted to be mounted through the opening in the sleeve means and through the opening in the deck means and to extend above the sleeve means so that concrete can be poured around the conduit means, the sleeve means and the attachment means above the deck means to embed the fitting assembly in the concrete wherein the fluid carrying conduit means is comprised of an outside sidewall secured to the inside sidewall of the sleeve means wherein a diameter of the outside sidewall of the conduit means is only slightly smaller than a diameter of the inside sidewall of the sleeve means and an inside sidewall between opposed open ends defining a second opening through the conduit means for carrying the fluid and the conduit means having a length so that the outside sidewall of the conduit means is able to be adjustably mounted along the inside sidewall of the sleeve means to adjust a distance between one of the opposed open ends of the conduit means and one of the opposed open ends of the sleeve means and wherein the opposed open ends of the conduit means extend through the opening in the deck means to provide for carrying the flid through the deck means.

2. The fitting assembly of claim 1 wherein the outside sidewall of the conduit means is bonded to the inside sidewall of the sleeve means to prevent seepage of fluids between the conduit means and the sleeve means.

3. The fitting assembly of claim 1 wherein the attachment means is a circular flange means mounted at one of the open ends of the sleeve means.

4. The fitting assembly of claim 3 wherein the flange means has openings adapted to receive fastening means that serve to secure the flange means to the apices of at least two spaced apart ridge portions or valley portions of the deck means so that the flange means provides for mounting the sleeve means to the deck means.

5. The fitting assembly of claim 1 wherein the deck means serves as a support for a partition means which encases the fitting assembly and wherein the fluid carrying conduit means of the fitting assembly serves to connect fluid carrying pipe means to the opposed ends of the conduit means for moving the fluids through the partition means and through the opening in the corrugated deck means.

6. The fitting assembly of claim 5 wherein the partition means is a poured concrete floor having a sloped upper surface and wherein a drain means is mounted on an uppermost one of the open ends of the conduit means, adjacent the concrete to be poured on the corrugated deck means to form the partition means providing the floor, so that fluids moved onto the sloped upper surface of the floor move towards the drain means and through the conduit means and the fluid carrying pipe means connected to an opposite end from the uppermost end of the conduit means to prevent the fluids moved onto the sloped upper surface of the floor from collecting on top of the partition means.

7. The fitting assembly of claim 1 wherein the opposed open ends of the conduit means are adapted to be connected to fluid carrying pipe means that serve for moving the fluid through the opening in the deck means by carrying the fluid through the conduit means and through the fluid carrying pipe means connected to the opposed open ends of the conduit means.

8. The fitting assembly of claim 1 wherein the inside sidewall and the outside sidewall of the conduit means are parallel.

9. The fitting assembly of claim 1 wherein the conduit means and the sleeve means are made of a plastic material which can be solvent welded or bonded together.

10. The fitting assembly of claim 1 wherein the annular ring has two sapced apart parallel sides perpendicular to the longitudinal axis and an annular side parallel to the axis.

11. The fitting assembly of claim 1 wherein a shim means is adapted to be mounted between the attachment means and the corrugated deck means to adjust an angle between a plane of the apices of the ridge portions or the valley portions of the corrugated deck means and the attachment means, wherein the shim means serves to adjust the longitudinal axis of the sleeve means with respect to the plane of the deck means when the sleeve means is secured to the deck means by the attachment means.

12. The fitting assembly of claim 1 wherein there is provided a pair of spaced apart brace means adapted to be mounted on the apex portions of at least two spaced apart ridge portions or valley portions of the corrugated deck means with the attachment means of the sleeve means mounted on the pair of brace means to provide for securing the fitting assembly to the deck means.

13. A method for connecting a fitting assembly through an opening in a deck means comprised of alternating side-by-side ridge and valley portions in a corrugated shape, wherein the fitting assembly serves to carry a fluid through the opening in the deck means, which comprises:

(a) providing the fitting assembly, which comprises: a sleeve means having an outside sidewall between opposed open ends and an inside sidewall providing an opening along a longitudinal axis of the sleeve means and with an annular ring around the outside sidewall of the sleeve means; an attachment means extending from the sleeve away from the longitudinal axis, wherein the attachment means serves to secure the sleeve means to the deck means mounted on an apex portion of at least two sapced apart ridge portions or valley portions of the corrugated deck means; and a fluid carrying conduit means adapted to be mounted through the opening in the sleeve means and comprised of an outisde sidewall secured to the inside sidewall of the sleeve means wherein a diameter of the outside sidewall of the conduit means is only slightly smaller than a diameter of the inside sidewall of the sleeve means and an inside sidewall between opposed open ends defining a second opening of the sleeve means for carrying the fluid and the conduit means having a lenght so that the outside sidewall of the conduit means ia ble to be adjustably mounted along the inside sidewall of the sleeve means to adjust a distance between one of the opposed open ends of the conduit means and one of the opposed open ends of the sleeve means and with the opposed open ends of the conduit means extending through the opening in the deck means;

(b) providing the deck means having the opening and securing the sleeve means to the apex portions of at least two sapced apart ridge portions or valley portions of the corrugated deck means by the attachment means so that the inside sidewall of the sleeve means ia aligned with the opening through the deck means;

(c) mounting the conduit means inside the sleeve means with the outside sidewall of the conduit means secured to the inside sidewall of the sleeve means and with the opposed open ends of the conduit means extending through the opening in the deck means and beyond the opposed open ends of the sleeve means to provide for moving a fluid through the conduit means and through the opening in the deck means; and (d) pouring concrete around the outside of the conduit means, sleeve means and attachment means above the deck means to provide the assembly for moving the fluid through the conduit means.

14. The method of claim 13 wherein fluid carrying pipe means are connected to both open ends of the conduit means and then moving the fluid through the conduit means and the fluid carrying pipe means so that the fluid is moved through the opening in the deck means.

15. The method of claim 13 wherein the deck means supports a partition means mounted on the deck means to encase the fitting assembly and wherein the fluid carrying conduit means is then connected to a pair of fluid carrying pipe means, one connected to each of the opposed open ends of the conduit means to provide for moving the fluid through the deck means and the partition means.

16. The method of claim 15 wherein the partition means is a poured concrete floor having a sloped upper surface and wherein a drain means as one of the pipe means is mounted on an uppermost one of the open ends of the conduit means, adjacent the upper surface of the partition means so that fluids moved onto the sloped upper surface of the floor are moved towards the drain means and through the conduit means and the fluid carrying pipe means connected to an opposite end from the uppermost end of the conduit means and wherein fluids moved onto the upper surface of the floor are prevented from collecting on the top of the partition means by draining the fluids through the drain means and the fitting assembly.

17. The method of claim 13 wherein the attachment means is a circular flange means mounted at one of the open ends of the sleeve means and with the flange means of the attachment means having openings that receive fastening means to secure the sleeve means to the corrugated deck means.

18. The method of claim 13 wherein the conduit means and the sleeve means are made of a plastic material and wherein the conduit means and the sleeve means are solvent welded or bonded together to seal the conduit means inside the sleeve means and to prevent the seepage of fluids between the conduit means and the sleeve means.

19. The method of claim 13 wherein the annular ring has two spaced apart parallel sides perpendicular to the longitudinal axis and an annular side parallel to the axis and wherein the sleeve means is encased in a partition means with the annular ring helping to secure the fitting assembly to the partition means.

20. The method of claim 13 wherein a shim means is inserted between the attachment means and the deck means to adjust an angle between a plane of the apices of the ridge portions or the valley portions of the deck means and the attachment means.

21. The method of claim 13 wherein the fitting assembly is secured to the deck means be a pair of sapced apart beace means that are mounted across the apex portions of at least two sapced apart ridge portions or valley portions of the corrugated deck means with the attachment means of the sleeve means mounted on the pair of brace means.

22. A building construction comprising a building having a fitting assembly mounted through an opening in a deck means for carrying a fluid through the opening in the deck means, wherein the deck means is comprised of alternating side-by-side ridge and valley portions, which comprises:

(a) the fitting assembly, which comprises: a sleeve means having an outside sidewall between opposed open ends ad an inside sidewall providing an opening along a longitudinal axis of the sleeve means and with an annular ring around the outside sidewall of the sleeve means; an attachment means extending from the sleeve means, away from the longitudinal axis, wherein the attachment means serves to secure the sleeve means to the deck means mounted on an apex portion of at least two sapced apart ridge portions or valley portions of the corrugated deck means; and a fluid carrying conduit means adapted to be mounted through the opening in the sleeve means and through the opening in deck means, and comprised of an outside sidewall wherein a diameter of the outside sidewall of the conduit means is only slightly smaller than a diameter of the inside sidewall of the sleeve means between opposed open ends and an inside sidewall dfining a second opening for carrying the fluid and the conduit means having a lenght so that the outside sidewall of the conduit means is adjustable along the inside sidewall of the sleeve means to adjust a distance between one of the opposed open ends of the conduit means and one of the opposed open ends of the sleeve ends and wherein the opposed open ends of the conduit means extend through the opening in the deck means to provide for carrying the fluid through the opening in the deck means;

(b) the deck means with the fitting assembly secured to the deck means so that the conduit means extends through the opening in the sleeve means and through the opening in the deck means for moving the fluid through the opening in the deck means; and (c) concrete around the outside of the conduit means, sleeve means and attachment means above the deck means.

23. The building construction of claim 22 wherein the outside sidewall of the conduit means contacts the inside sidewall of the sleeve means to prevent seepage of fluids between the conduit means and the sleeve means.

24. The building construction of claim 22 wherein the attachment means is a circular flange means mounted at one of the open ends of the sleeve means.

25. he building construction of claim 22 wherein there are fluid carrying pipe means connected to both ends of the conduit means and wherein the pipe means serve to move the fluid through the opening in the deck means by moving the fluids through the conduit means mounted through the opening in the deck means and through the pipe means connected to the opposed ends of the conduit means.

26. The building construction of claim 22 wherein the flange means has openings that receive fastening means for securing the sleeve means to the corrugated deck means.

27. The building construction of claim 22 wherein the deck means serves as a support for a partition means which encases the fitting assembly and wherein the conduit means of the fitting assembly serves to connect fluid carrying pipe means to the opposed ends of the conduit means for moving the fluid through the partition means and through the opening in the corrugated deck means.

28. The building construction of claim 27 wherein the partition means is a poured concrete floor having a sloped upper surface and wherein a drain means as one of the pipe means, is mounted on an uppermost one of the open ends of the conduit means, adjacent the concrete to be poured on the corrugated deck means to form the partition means providing the floor, so that fluids moved onto the sloped upper surface of the floor move towards the drain means and through the conduit means and the fluid carrying pipe means connected to an opposite end from the uppermost end of the conduit means to prevent the fluids moved onto the sloped upper surface of the floor from collecting on top of the partition means.

29. The building construction of claim 22 wherein the inside sidewall and the outside sidewall of the conduit means are parallel.

30. The building construction of claim 22 wherein the conduit means and the sleeve means are made of a plastic material and are solvent welded or bonded together.

31. The building construction of claim 22 wherein the annular ring has two sapced apart parallel sides perpendicular to the longitudinal axis and an annular side parallel to the axis.

32. The building construction of claim 22 wherein a shim means is provided between the attachment means and the corrugated deck means to adjust an angle between a plane of the apices of the ridge portions or the valley portions of the corrugated deck means and the attachment means, wherein the shim means serves to adjust the longitudinal axis of the sleeve means with respect to the plane of the deck means.

33. The building construction of claim 22 wherein there is provided a pair of spaced apart brace means mounted across the apex portions of at least two spaced apart ridge portions or valley portions of the corrugated deck means with the attachment means of the sleeve means mounted on the pair of brace means to provide for securing the fitting assembly to the deck means.

* * * * *

UNITED STATES PATENT AND TRADEMARK OFFICE

CERTIFICATE OF CORRECTION

PATENT NO. : 5,293,724

DATED : March 15, 1994

INVENTOR(S) : Kenneth R. Cornwall

It is certified that error appears in the above—identified patent and that said Letters Patent is hereby corrected as shown below:

Column 4, line 8, "Fig. and" should read --Fig. 1 and --.

Column 6, line 15, "Type fire" should read --Type 1 fire--.

Column 6, line 42, "sleeve the" should read --sleeve 11, the--.

Column 6, line 43, "sleeve The" should read --sleeve 11. The--.

Column 8, line 42, "FIGS. and 4" should read --FIGS. 1 and 4--.

Column 9, line 29, "Table "A" should read --Table 1, "A"--.

Column 10, line 41 (Claim 1), "flid" should be --fluid--.

Column 12, line 2 (Claim 13), "lenght" should be --length--.

Column 12, line 3 (Claim 13), "ia ble" should read --is able--.

Column 13, line 16 (Claim 21), "be" should be --by--.

Column 13, line 16 (Claim 21), "sapced" should be --spaced--.

UNITED STATES PATENT AND TRADEMARK OFFICE

CERTIFICATE OF CORRECTION

PATENT NO. : 5,293,724

DATED : March 15, 1994

INVENTOR(S) : Kenneth R. Cornwall

It is certified that error appears in the above—identified patent and that said Letters Patent is hereby corrected as shown below:

Column 13, line 17 (Claim 21), "beace" should be --brace--.

Column 13, line 18 (Claim 21), "sapced" should be --spaced--.

Column 13, line 30 (Claim 22), "ad" should be --and--.

Column 13, line 37 (Claim 22), "sapced" should be --spaced--.

Column 13, line 47 (Claim 22), "dfining" should be --defining--.

Column 13, line 48 (Claim 22), "lenght" should be --length--.

Column 14, line 8 (Claim 25), "he" should be --The--.

UNITED STATES PATENT AND TRADEMARK OFFICE

CERTIFICATE OF CORRECTION

PATENT NO. : 5,293,724

DATED : March 15, 1994

INVENTOR(S) : Kenneth R. Cornwall

It is certified that error appears in the above-indentified patent and that said Letters Patent is hereby corrected as shown below:

Column 14, line 49 (Claim 31), "sapced" should be --spaced--.

Signed and Sealed this

Eighteenth Day of October, 1994

*Attest:*

Bruce Lehman

BRUCE LEHMAN

*Attesting Officer*

*Commissioner of Patents and Trademarks*